US007066120B2

(12) United States Patent
Geyer et al.

(10) Patent No.: US 7,066,120 B2
(45) Date of Patent: Jun. 27, 2006

(54) TWO-CYCLE ENGINE

(75) Inventors: Werner Geyer, Berglen (DE); Claus Fleig, Ludwigsburg (DE); Helmar Amend, Waiblingen (DE); Klaus-Martin Uhl, Baltmannsweiler (DE); Jörg Schlossarczyk, Winnenden (DE)

(73) Assignee: Andreas Stihl AG & Co. KG (DE)

( * ) Notice: Subject to any disclaimer, the term of this patent is extended or adjusted under 35 U.S.C. 154(b) by 67 days.

(21) Appl. No.: 10/799,167

(22) Filed: Mar. 12, 2004

(65) Prior Publication Data

US 2004/0182339 A1 Sep. 23, 2004

(30) Foreign Application Priority Data

Mar. 19, 2003 (DE) ..... 103 12 097

(51) Int. Cl.
*F02B 75/00* (2006.01)

(52) U.S. Cl. ..... 123/77 PP; 123/195 C

(58) Field of Classification Search ..... 123/73 PP, 123/195 C

See application file for complete search history.

(56) References Cited

U.S. PATENT DOCUMENTS

| | | | | |
|---|---|---|---|---|
| 5,025,760 | A | 6/1991 | Webb et al. | |
| 6,161,509 | A * | 12/2000 | Dahlberg et al. | 123/73 PP |
| 6,591,793 | B1 * | 7/2003 | Nemoto et al. | 123/73 PP |
| 6,634,326 | B1 * | 10/2003 | Radel et al. | 123/73 PP |
| 2002/0088412 | A1 * | 7/2002 | Radel et al. | 123/73 PP |

* cited by examiner

*Primary Examiner*—John T. Kwon
(74) *Attorney, Agent, or Firm*—Robert W Becker & Associates; Robert W Becker

(57) ABSTRACT

A two-cycle engine is provided that has a cylinder in which is formed a combustion chamber delimited by a reciprocating piston that via a connecting rod drives a crankshaft rotatably mounted in a crankcase. An inlet is provided for a supply of fuel into the crankcase, and an outlet leads out of the combustion chamber. In predetermined positions of the piston the crankcase communicates with the combustion chamber via at least one transfer channel. The cover is secured to a connecting flange of the cylinder, the cover closes off the transfer channel on an outer side of a cylinder, the connecting flange is inclined relative to the longitudinal axis of the cylinder by an angle that opens in a direction toward the crankcase.

14 Claims, 4 Drawing Sheets

Fig. 7
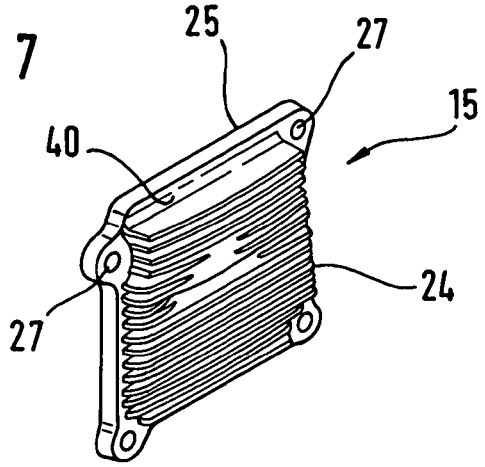
Fig. 8
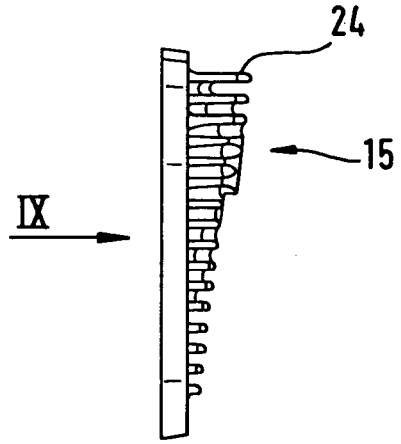
Fig. 9
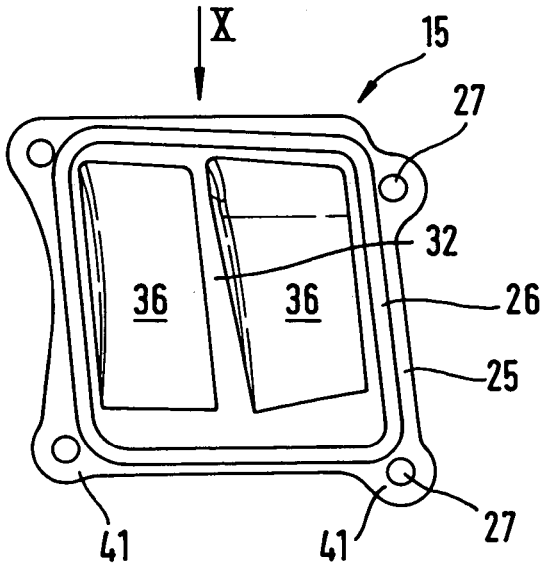
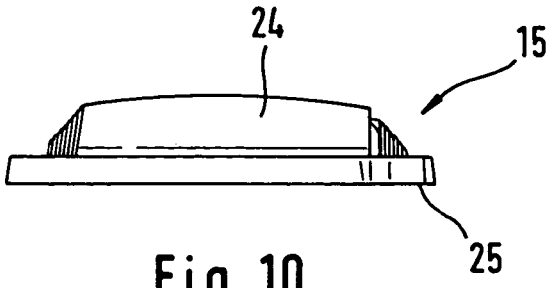
Fig. 10
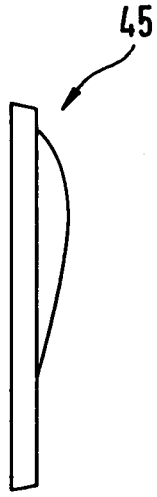
Fig. 11

TWO-CYCLE ENGINE

BACKGROUND OF THE INVENTION

The invention relates to a two-cycle engine, in particular for a manually operated tool such as a chain saw, a parting-off grinder or similar device.

A two-cycle engine with overflow or transfer channels which are closed on the outside of the cylinder by covers is known from U.S. Pat. No. 5,025,760 A. The transfer channels run parallel to the longitudinal cylinder axis in the area of the cylinder and are connected to the combustion chamber by an area running approximately perpendicular to said longitudinal cylinder axis. The sharp diversion of the flow in the transfer channel leads to a high flow resistance. A lower flow resistance can be achieved by designing the transfer channel as a loop channel. Where the cylinder is manufactured by means of diecasting, if the transfer channel is designed as a loop channel it is, however, no longer possible to remove the cylinder from its mold simply since the mold removal angles are not sufficiently large.

SUMMARY OF THE INVENTION

The object of the invention is to design a two-cycle engine of the aforementioned general type with a cylinder which can be manufactured simply by means of diecasting.

This object is achieved by means of a two-cycle engine having a cylinder in which is formed a combustion chamber that is delimited by a reciprocating piston that via a connecting rod drives a crank shaft that is rotatably mounted in a crankcase, wherein an inlet is provided for a supply of fuel into the crankcase, wherein the cylinder has an outlet leading out of the combustion chamber, and wherein in predetermined positions of the piston, the crankcase communicates with the combustion chamber via at least one transfer channel; a cover is secured to a connecting flange of the cylinder, wherein the cover closes off the at least one transfer channel on an outer side of the cylinder, and wherein the connecting flange is inclined relative to a longitudinal axis of the cylinder by an angle that opens in a direction toward the crankcase.

By inclining the connecting flange in relation to the longitudinal cylinder axis, the section of the transfer channel which is located in the cover is enlarged in such a manner that the section of the external wall of the transfer channel which runs in a curve is contained completely within the cover. The section of the transfer channel which runs approximately perpendicular to the longitudinal cylinder axis in the cylinder is shortened and can therefore be removed from its mold with ease. At the same time, the transfer channels can also be designed in a manner favorable to flow.

The transfer channel is designed in particular as a hook or loop channel. The angle between the connecting flange and the longitudinal cylinder axis is expediently between 1° and 20°, in particular between 5° and 15°. One edge of the cover is designed to lie on the connecting flange by providing a peripheral groove to receive a seal. A good seal between the cover and the cylinder can thus be guaranteed in a simple manner. In order to be able to design the transfer channel in any shape and to achieve a smooth transition between the cover and the cylinder, there is provided on the cover a nose which projects into the cylinder and forms the roof of an transfer channel facing the combustion chamber. In this arrangement, the nose lies behind a shoulder on the cylinder in particular at a distance to the cylinder bore.

The cylinder advantageously has a central plane which divides the outlet approximately in the center and comprises the longitudinal cylinder axis, at least two channels which are closed by a common cover being positioned on one side of the central plane. Two transfer channels guarantee a good scavenging result, thereby achieving low exhaust emissions. The closing of both transfer channels by a common cover reduces the number of components required for the two-cycle engine. Positioning the cover on the connecting flange can be achieved simply by designing the internal walls of the transfer channels provided on the cylinder to project beyond the connecting flange into the cover and the cover to have a strut which lies between two internal walls in the direction of the circumference of the cylinder. The strut largely fixes the position of the cover on the connecting flange. At the same time, it also ensures a good separation between the two transfer channels.

One transfer channel is advantageously continued in the cylinder wall to the crankcase. In this arrangement, the end of the transfer channel facing the crankcase runs not into the cylinder bore but directly into the crankcase. This results in an advantageous shape of the transfer channel favorable to flow. At the same time, an transfer channel of this type may also be produced by means of diecasting with a simple slider. The cover is advantageously screwed to the cylinder. This results in a simple, fast fixing of the cover to the cylinder. The cover is expediently an injection mold part made of metal or plastic. In particular, the cover has cooling fins. It may, however, also be useful for the cover to be a deep-drawn part. In order to achieve symmetrical scavenging of the combustion chamber, two transfer channels symmetrical to the central plane are positioned on each side of the central plane.

BRIEF DESCRIPTION OF THE DRAWINGS

Embodiments of the invention are detailed below with reference to the drawings, in which:

FIG. 7 shows a perspective view of a cover;

FIG. 8 shows a side view of a cover;

FIG. 9 shows a side view of a cover in the direction of the arrow marked IX in FIG. 8;

FIG. 10 shows a side view of a cover in the direction of the arrow marked X in FIG. 9; and FIG. 11 shows a side view of a cover.

DESCRIPTION OF SPECIFIC EMBODIMENTS

Figure 1:
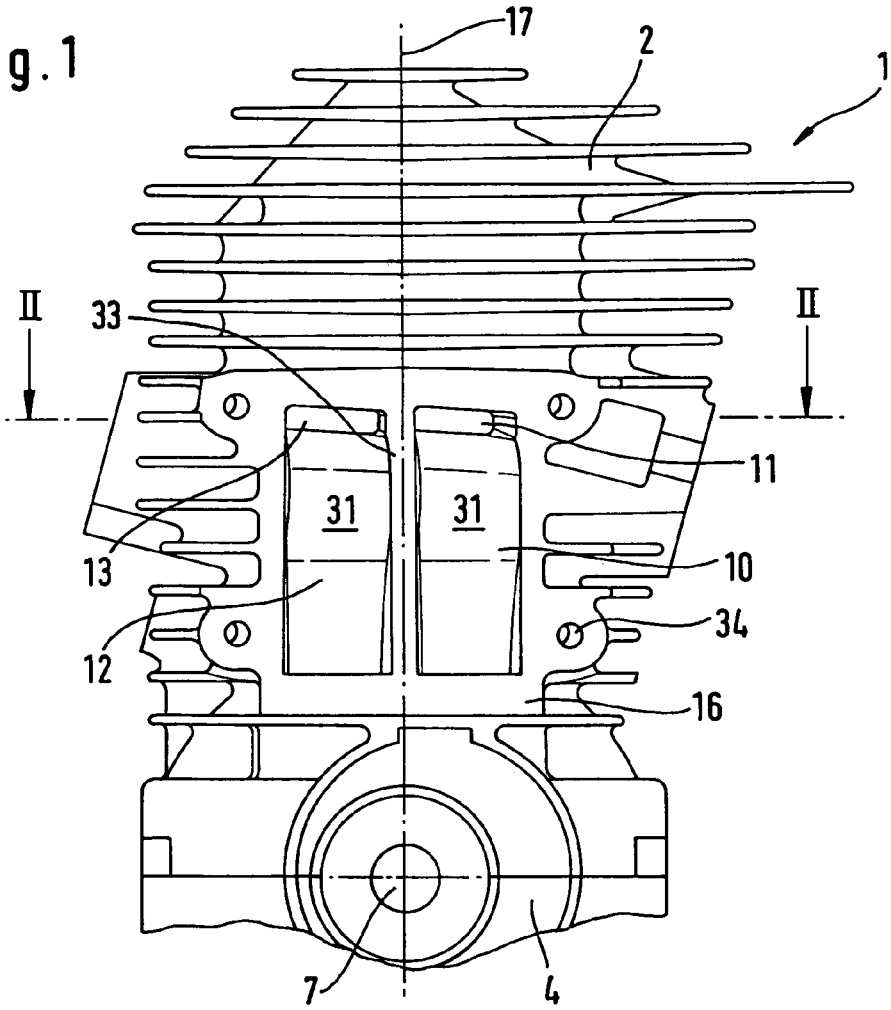
FIG. 1 shows a side view of a two-cycle engine.
Figure 4:
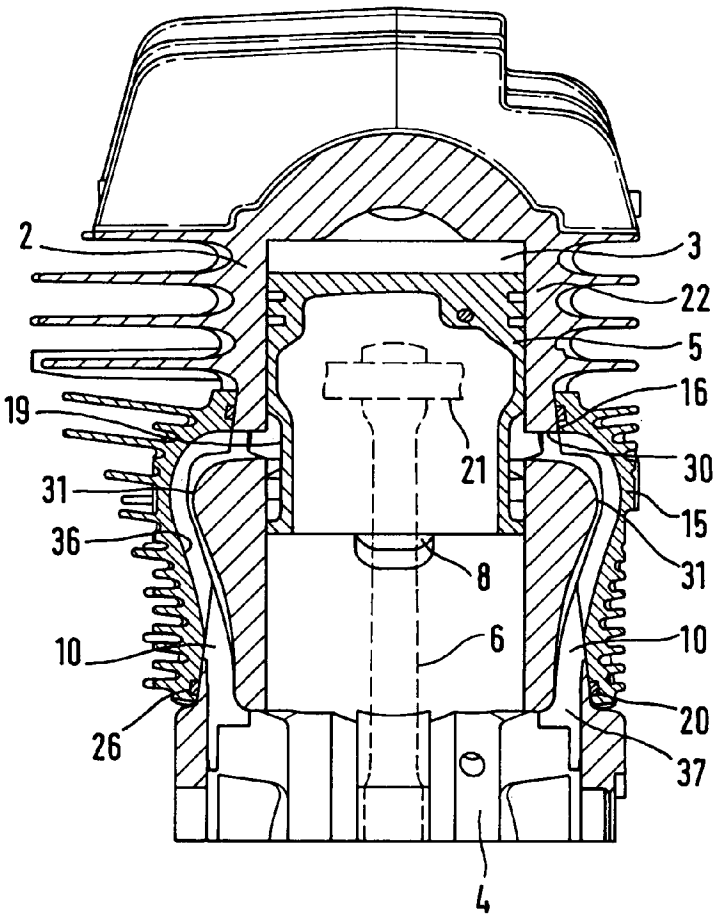
FIG. 4 shows a section along the line marked IV—IV in FIG. 3.

The two-cycle engine 1 illustrated in FIG. 1 has a cylinder 2 in which is located the combustion chamber 3 illustrated in FIG. 4. As shown in FIG. 4, the combustion chamber 3 is bounded by the piston 5. The piston 5 drives the crankshaft 7 mounted in the crankcase 4 which is illustrated in FIG. 1 via the connecting rod 6. The connecting rod 6 is fixed to the piston 5 illustrated in FIG. 4 by a broken line by a piston bolt 21. The crankcase 4 is connected via the overflow or transfer channels 10 and 12 in predetermined piston positions to the combustion chamber 3. The transfer channels 10 and 12 are designed to be open in the direction of the outside of the cylinder. The internal walls 31 of the transfer channels 10 and 12 are located on the cylinder. The transfer channels 10 and 12 are designed as loop channels such that the internal walls 31 of the transfer channels 10, 12 curve in the direction of the longitudinal cylinder axis 17. On the outside of the cylinder, the transfer channels 10 and 12 are enclosed by a connecting flange 16 to which can be fixed a cover for closing the transfer channels 10 and 12. The connecting flange runs evenly and also extends between the two transfer channels 10 and 12. The internal walls 31 of the transfer channels extend beyond the plane formed by the connecting flange 16, thereby forming a space 33 between the two internal walls 31 at the connecting flange 16. The connecting flange 16 has four holes 34 at which a cover can be screwed to the connecting flange 16.

Figure 2:
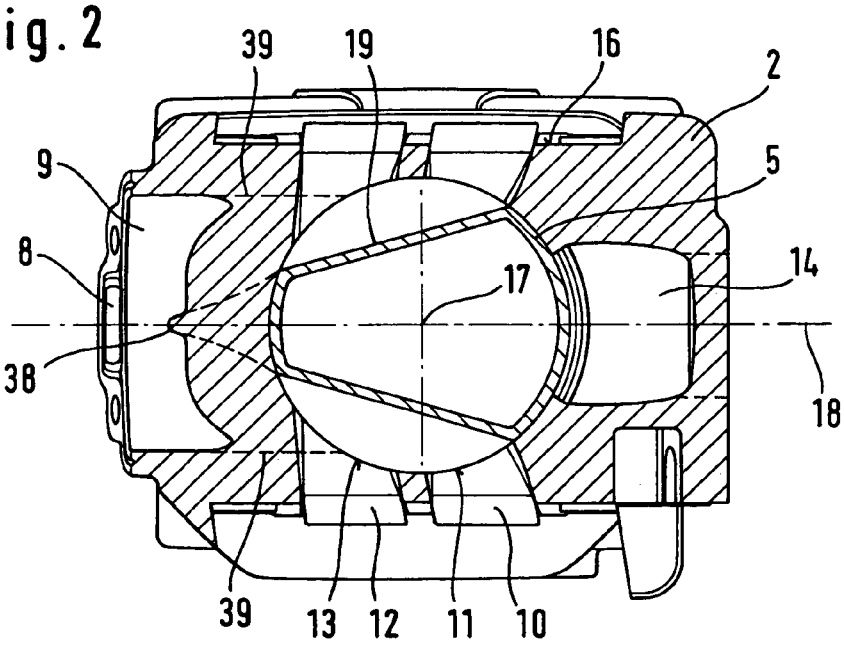
FIG. 2 shows a section along the line marked II—II in FIG. 1.

As illustrated in FIG. 2, the two-cycle engine 1 has an inlet 8 for the supply of fuel, as a fuel/air mixture for example, into the crankcase 4. The two-cycle engine 1 has an air inlet which divides into two branches 39 in the cylinder 2. In this arrangement, the branches 39 run symmetrical to a central plane 18 which includes the longitudinal cylinder axis 17 and which divides an outlet 14 from the combustion chamber 3 approximately in the center. Provided in the cylinder 2 is a flow divider 38 which projects into the air duct 9 dividing it into the two branches 39 symmetrically to the central plane 18. The two-cycle engine 1 has two transfer channels 10 near the outlet which run into the combustion chamber at transfer windows 11 and two transfer channels 12 further away from the outlet which run into the combustion chamber 3 at transfer windows 13. In this arrangement, the transfer channels 10 and 12 are also symmetrical to the central plane 18. The piston 5 has two piston cut-outs 19 symmetrical to the central plane 18. In the piston position illustrated in FIG. 2, the branches 39 of the air duct 9 are connected to the transfer channels 10 and 12 via the piston cut-outs 19 such that largely fuel-free air is able to flow out of the air duct 9 through the transfer windows 11 and 13 and into the transfer channels 10 and 12.

Figure 3:
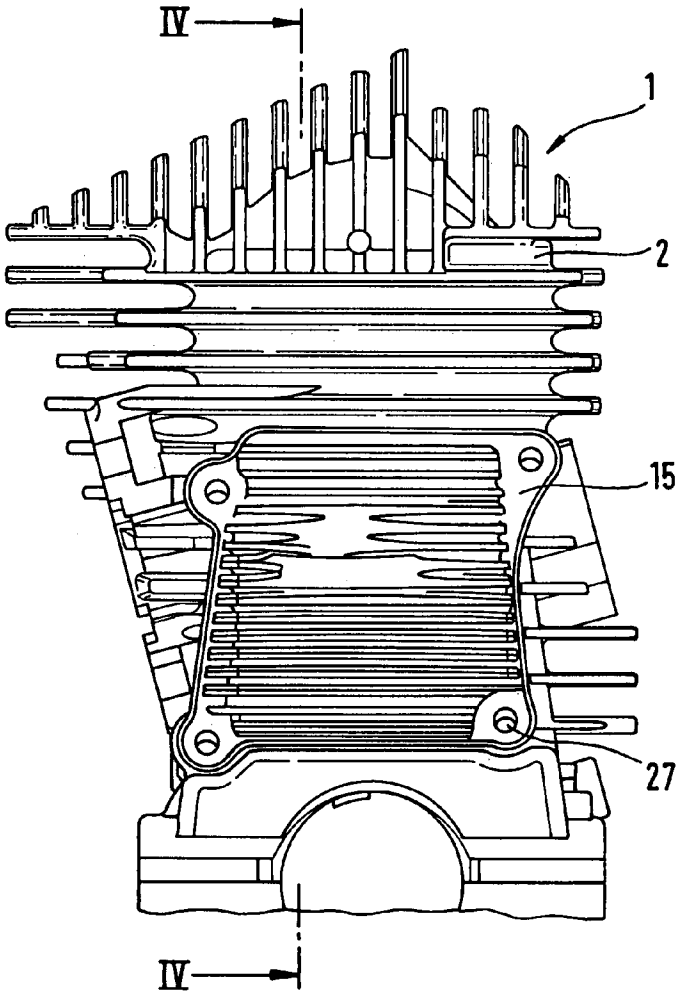
FIG. 3 shows a side view of a part of a two-cycle engine.

FIG. 3 shows a two-cycle engine 1 with a cover 15 positioned on the connecting flange. The cover 15 has four holes 27 at which the cover can be screwed to the holes 34 in the connecting flange 16. As shown in the section in FIG. 4, the section of the external wall 36 of the transfer channels which curves approximately in the direction of the longitudinal cylinder axis 19 is provided in the covers 15. In this arrangement, each cover 15 closes a transfer channel 10 near the outlet and an transfer channel 11 further away from the outlet. The external wall 36 runs at a roughly constant distance from the internal wall 31 thereby giving an approximately constant flow cross-section in the transfer channels 10 and 12. The mouth sections 37 of the transfer channels 10 and 12 at which the transfer channels 10 and 12 run into the crankcase 4 are located in the cylinder 2. In this arrangement, the mouth sections 37 run approximately in the direction of the longitudinal cylinder axis 17. The transfer channels 10 and 12 are shaped in such a manner that that when the two-cycle engine 1 is fitted in the normal tool operating position there is always a downhill gradient in the transfer channels 10 and 12 in the direction of the crankcase 4. This means that fuel is unable to collect in the transfer channels 10 and 12 which would otherwise cause the engine to cut out if the combustion chamber 3 were to be emptied abruptly.

The roof 30 of the transfer channels 10 and 12 is located in the cylinder wall 22. In this arrangement, the roof 30 is the wall of the transfer channels 10 and 12 facing the combustion chamber 3 in the channel section which runs approximately perpendicular to the longitudinal cylinder axis 17 adjacent to the transfer windows 11, 13. The covers 15 have a peripheral groove 26 in which is positioned a seal 20. The seal 20 lies on the connecting flange 16 of the cylinder 2 and thereby seals the transfer channels 10 and 12 against the environment. In the piston position illustrated in FIG. 4, the transfer channels 10 and 12 are connected to the air inlet 9 illustrated in FIG. 2 via the piston windows 19, thereby allowing largely fuel-free air to flow through the transfer windows 11, 13 in the direction of the crankcase 4.

Figure 5:
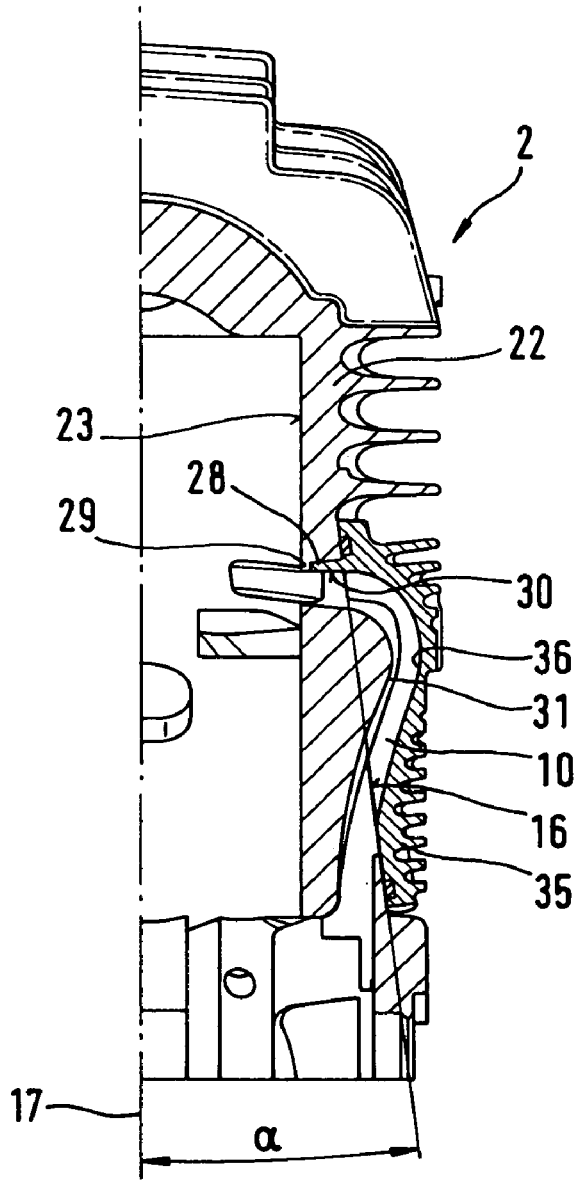
FIG. 5 shows the cylinder illustrated in FIG. 4 not containing a piston.

FIG. 5 shows a partial section of the cylinder 2 not containing a piston 5. The connecting flange 16 is inclined at an angle ($\alpha$) in a sectional plane perpendicular to the central plane 18 in relation to the longitudinal cylinder axis 17. The angle ($\alpha$) opens in the direction of the crankcase 4 such that the distance between the cover and the central plane 18 in the area of the transfer windows 11, 13 is smaller than at the side facing the crankcase 4. The angle ($\alpha$) is expediently between 1° and 20°, in particular between 5° and 15°. In the view shown in FIG. 5, the longitudinal cylinder axis 17 is located behind the sectional plane.

Figure 6:
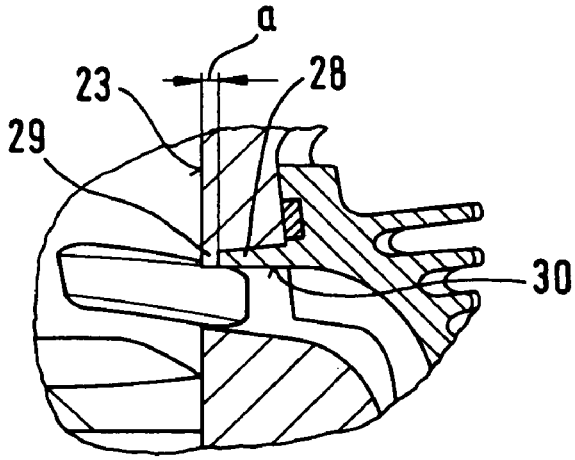
FIG. 6 shows an enlarged section of FIG. 5.

The cover 35 illustrated in FIG. 5 has a nose 28 which forms the roof 30 of the transfer channel 10. The nose 28 lies behind a shoulder 29 which is formed on the cylinder wall 22. The section of the external wall 36 of the transfer channel 10 located in the cover 35 has no undercuts and the cover 35 can therefore easily be produced by means of diecasting. At the same time, the section of the transfer channel located in the cylinder wall 22 has a sufficiently large aperture to guarantee good removal from the mold. As is shown in the enlarged view in FIG. 6, the shoulder 28 is positioned a distance (a) from the cylinder bore 23. This achieves a good seal between the cover 35 and the cylinder 2.

FIGS. 7 to 10 show an enlarged view of the cover 15. Located on the outward facing wall 40 of the cover 15 are cooling fins 24. The cover 15 is expediently produced by means of diecasting and may be made of metal or plastic, in particular a heat-stabilized plastic. The cover 15 has a peripheral edge 25 which has widened areas 41 in which are positioned holes 27. Running around the two sections of the external walls 36 of the transfer channels located in the cover 15 is the peripheral groove 26 which receives a seal. Between the two transfer channels 36 runs a strut 32 which, when the cover 15 is mounted on the cylinder 2, lies between the internal walls 31 of the two transfer channels 10 and 12 and thereby fixes the position of the cover 15 in the direction of the circumference of the cylinder 2.

FIG. 11 shows an embodiment of a cover 45 which has no cooling fins and which can be designed as a deep-drawn part. The further features of this cover 45 correspond to those of cover 15.

The specification incorporates by reference the disclosure of German priority document 103 12 097.1 filed Mar. 19, 2003.

The present invention is, of course, in no way restricted to the specific disclosure of the specification and drawings, but also encompasses any modifications within the scope of the appended claims.

We claim:

1. A two-cycle engine, comprising:

a cylinder in which is formed a combustion chamber that is delimited by a reciprocating piston that via a connecting rod drives a crankshaft that is rotatably mounted in a crankcase, wherein an inlet is provided for a supply of fuel into said crankcase, wherein said cylinder has an outlet leading out of said combustion chamber, and wherein in predetermined of said piston said crankcase communicates with said combustion chamber via at least one transfer channel; and a cover that is secured to a connecting flange of said cylinder, wherein said cover closes off said at least one transfer channel on an outer side of said cylinder, and wherein said connecting flange is inclined relative to a longitudinal axis of said cylinder by an angle that opens in a direction toward said crankcase, so that said cylinder is adapted to be manufactured by diecasting.

2. A two-cycle engine according to claim 1, wherein said at least one transfer channel is embodied as a loop channel having a curved section in an external wall portion thereof, and wherein said curved section is formed entirely in said cover.

3. A two-cycle engine according to claim 1, wherein said angle is from 1 to 20°.

4. A two-cycle engine according to claim 3, wherein said angle is from 5 to 15°.

5. A two-cycle engine according to claim 1, wherein said cover is provided with an edge via which said cover rests against said connecting flange, and wherein said edge of said cover is provided with a peripheral groove for receiving a seal.

6. A two-cycle engine according to claim 1, wherein a nose is formed on said cover, and wherein said nose extends into said cylinder and forms a roof of said at least one transfer channel that faces said combustion chamber.

7. A two-cycle engine according to claim 6, wherein said cylinder is provided with a shoulder, and wherein said nose rests on said shoulder at a distance from a bore of said cylinder.

8. A two-cycle engine according to claim 1, wherein said cylinder has a central plane that divides the outlet approximately centrally, wherein said central plane includes said longitudinal axis of said cylinder, and wherein on one side of said central plane at least two transfer channels are disposed that are closed off by a common cover.

9. A two-cycle engine according to claim 8, wherein inner walls of said transfer channels are formed on said cylinder and project beyond said connecting flange into said cover and wherein said cover is provided with a strut that in a circumferential direction of said cylinder is disposed between two inner walls of said transfer channels.

10. A two-cycle engine according to claim 1, wherein one transfer channel continues in a wall of said cylinder to said crankcase.

11. A two-cycle engine according to claim 1, wherein said cover is screwed to said cylinder.

12. A two-cycle engine according to claim 1, wherein said cover is an injection molded part.

13. A two-cycle engine according to claim 1, wherein said cover is provided with cooling fins.

14. A two-cycle engine according to claim 1, wherein said cover is a deep-drawn part.

* * * * *